US007987895B2

(12) United States Patent
Garza-Ondarza et al.

(10) Patent No.: US 7,987,895 B2
(45) Date of Patent: Aug. 2, 2011

(54) METHOD AND APPARATUS FOR IMPROVED HEAT EXTRACTION FROM ALUMINUM CASTINGS FOR DIRECTIONAL SOLIDIFICATION

(75) Inventors: Oscar Garza-Ondarza, Nuevo Leon (MX); Juan Francisco Mojica-Briseño, Nuevo León (MX)

(73) Assignee: Tenedora Nemak, S.A. de C.V., Garcia (MX)

( * ) Notice: Subject to any disclaimer, the term of this patent is extended or adjusted under 35 U.S.C. 154(b) by 0 days.

(21) Appl. No.: 12/502,054

(22) Filed: Jul. 13, 2009

(65) Prior Publication Data

US 2009/0314453 A1 Dec. 24, 2009

Related U.S. Application Data

(62) Division of application No. 11/370,625, filed on Mar. 8, 2006, now abandoned.

(60) Provisional application No. 60/662,192, filed on Mar. 16, 2005.

(51) Int. Cl.
*B22D 27/04* (2006.01)
*B22C 9/02* (2006.01)

(52) U.S. Cl. ..... 164/125; 164/128; 164/348; 164/349

(58) Field of Classification Search ..... 164/125, 164/128, 348, 349, 522, 131
See application file for complete search history.

(56) References Cited

U.S. PATENT DOCUMENTS

2004/0050524 A1* 3/2004 Grassi et al. ..... 164/131
2005/0022957 A1* 2/2005 Crafton et al. ..... 164/5

* cited by examiner

*Primary Examiner* — Kevin P Kerns
(74) *Attorney, Agent, or Firm* — Frommer Lawrence & Haug LLP; A. Thomas S. Safford

(57) ABSTRACT

Method and apparatus for improving the quality and mechanical properties of an aluminum alloy engine cylinder block or other large or complex castings by providing sand molds bound with a soluble binder only at locations on said casting from which rapid cooling for directional solidification and/or improved localized mechanical properties are desired with said molds being otherwise bound at the remaining locations only with a more typical insoluble binder.

4 Claims, 2 Drawing Sheets

METHOD AND APPARATUS FOR IMPROVED HEAT EXTRACTION FROM ALUMINUM CASTINGS FOR DIRECTIONAL SOLIDIFICATION

RELATED APPLICATION

This is a division of and claims benefit of parent application Ser. No. 11/370,625 filed Mar. 8, 2006, abandoned; which in turn claims benefit from provisional application Ser. No. 60/662,192 filed Mar. 16, 2005 in accordance with at least 35 USC section 121 (including priority benefit from section 120).

FIELD OF THE INVENTION

The invention relates to production of aluminum alloy castings, particularly the production of relatively large and/or complex castings, such as high-quality aluminum cylinder blocks for automotive engines, using sand molds.

BACKGROUND OF THE INVENTION

It is known from U.S. Pat. No. 5,297,611 and its division, U.S. Pat. No. 5,477,906, to produce aluminum-alloy cylinder blocks wherein a thermal gradient is formed in the cast piece during cooling to promote controlled solidification of the liquid aluminum-alloy within a sand mold by the utilization of heat-conductive inserts (which function as heat sinks and in the industry are generally called "chills"). To function as a heat-sink, the chill plate has mass (usually of iron) that at least begins at a temperature lower than the solidification temperature of the aluminum alloy. It thus promotes early solidification of the block starting at the surface of the chill in contact with the newly cast block. The chill is typically placed so that the solidification is directed to proceed in a direction towards the source of molten metal, usually at the opposite end of the block. This avoids premature solidification in areas that would block access to the source of molten metal (which blockage prevents filling in detrimental voids that can otherwise be caused by the shrinkage resulting from cooling during solidification of the casting). The utilization of such chills aids in producing high-quality engine blocks, because the liquid aluminum solidifies in a more orderly manner thereby helping to eliminate such voids and associated shrinkage porosity which often occur when the block is allowed uncontrolled solidification in all directions.

Although there are suggestions in the prior art that the chill or thermal core can be brought into contact with an external heat sink or other heat extraction means so as to maintain a continuing heat extraction from the casting throughout the solidification step, said patents are vague with respect to a practical way of achieving such heat extraction. They refer to some means for continuously removing heat from the solidifying melt to thereby develop and maintain the strong thermal gradients necessary to achieve directional solidification, and teach two general ways of achieving this cooling: (a) by increasing the heat extraction area of the chill by providing it with cooling fins (which then may be contacted with forced cooling air or mist, as needed); and (b) by providing a channel through said chill for allowing water to be circulated to cool the chill.

These and other currently-used chills do provide means for promoting directional solidification. However, the applicants have discovered that more rapid and better-controlled directional solidification, with consequent improved quality of the castings, can be achieved by carefully controlled selective direct water impingement on specific areas of the solidifying casting. This is accomplished in part by utilizing sand molds and/or cores that are formed with a water-soluble binder which are at least partially removed by jets of water to cool and quickly begin to play directly on the selected newly-solidified metal skin of the casting, thus resulting in a greater thermal gradient in and a more rapid cooling of the casting, whereby the solidification of the block is thereby improved and strongly driven in the desired direction.

Part of this improvement is well described in the recently published U.S. pat. application No. 2004/0050524 A1 (filed Mar. 18, 2004 and entitled "Mold-Removal Casting Method and Apparatus"). This and all patents or other documents cited in this text, and all documents cited or referenced in the documents cited in this application as filed, are incorporated herein by reference. Documents incorporated by reference into this application or any teachings therein may be used in the practice of this invention.

However, there remain significant drawbacks to the teaching and disclosure in the 2004/0050524 publication. The water soluble binders typically are of higher cost and may have less desirable molding attributes. In addition, it can be difficult to control the specific application of the cooling water (or solvent) to precisely defined and delimited areas of the complex casting (needed to achieve the most effective control over the site of the cooling to give the best and directional accuracy of cooling and thereby of the controlled solidification progression therefrom to obtain the desired high quality results).

SUMMARY AND OBJECTS OF THE INVENTION

It is an object of the present invention to provide new processes and apparatus for casting aluminum alloy engine cylinder blocks in sand molds with even better quality and for overcoming the drawbacks encountered in currently known processes.

It is a further object of the present invention to provide new processes and apparatus for casting aluminum alloy engine cylinder blocks in sand molds wherein the solidification of the liquid metal melt is directed to proceed in a predetermined direction by enhancing the heat extraction of the casting undergoing solidification by contacting precise portion(s) of said casting with a fluid cooling agent.

Other objects of the invention will be pointed out or will be evident from the following description of the preferred embodiments and the accompanying drawings.

Method and apparatus for improving the quality and mechanical properties of an aluminum alloy engine cylinder block or other large or complex castings by providing sand molds bound with a soluble binder only at locations on said casting from which rapid cooling for directional solidification and/or improved localized mechanical properties are desired with said molds being otherwise bound at the remaining locations only with a more typical insoluble binder.

The present invention comprises new processes and apparatus for improving the quality and mechanical properties of an aluminum alloy engine cylinder block or other large or complex castings by providing sand molds bound with a soluble binder only at locations on said casting from which rapid cooling for directional solidification and/or improved localized mechanical properties are desired with said molds being otherwise bound at the remaining locations only with an insoluble binder, and in the process proceeding to remove initially only those portions of the sand mold bound with the soluble binder by contacting such portions with a stream of solvent, normally water, whereby said cooling solvent removes the soluble portions only and contacts said casting accurately and selectively thus providing a focused cooling with resulting improved localized control while retaining the benefits of superior quality and less expense typically derived from use of well-established insoluble binders.

The relatively low heat conductivity of the insoluble sand mold portions remaining in place can advantageously be used to protect those parts of the cooling casting that should have their solidification retarded relative to the remainder of the casting.

Additionally, the insoluble portions can be positioned at strategic points to support the casting while hardening, while permitting removal of sufficient other portions of the mold to accelerate the cooling (all without danger of slumping or distortion of an insufficiently supported cooling casting).

Careful shaping of the relative soluble and insoluble portions relative to one another and/or relative to the solvent stream and the casting help to further enhance the control over the cooling, such as by funneling the solvent stream to and timing of the erosion of the soluble portions.

DESCRIPTION OF PREFERRED EMBODIMENTS OF THE INVENTION

Figure 1:
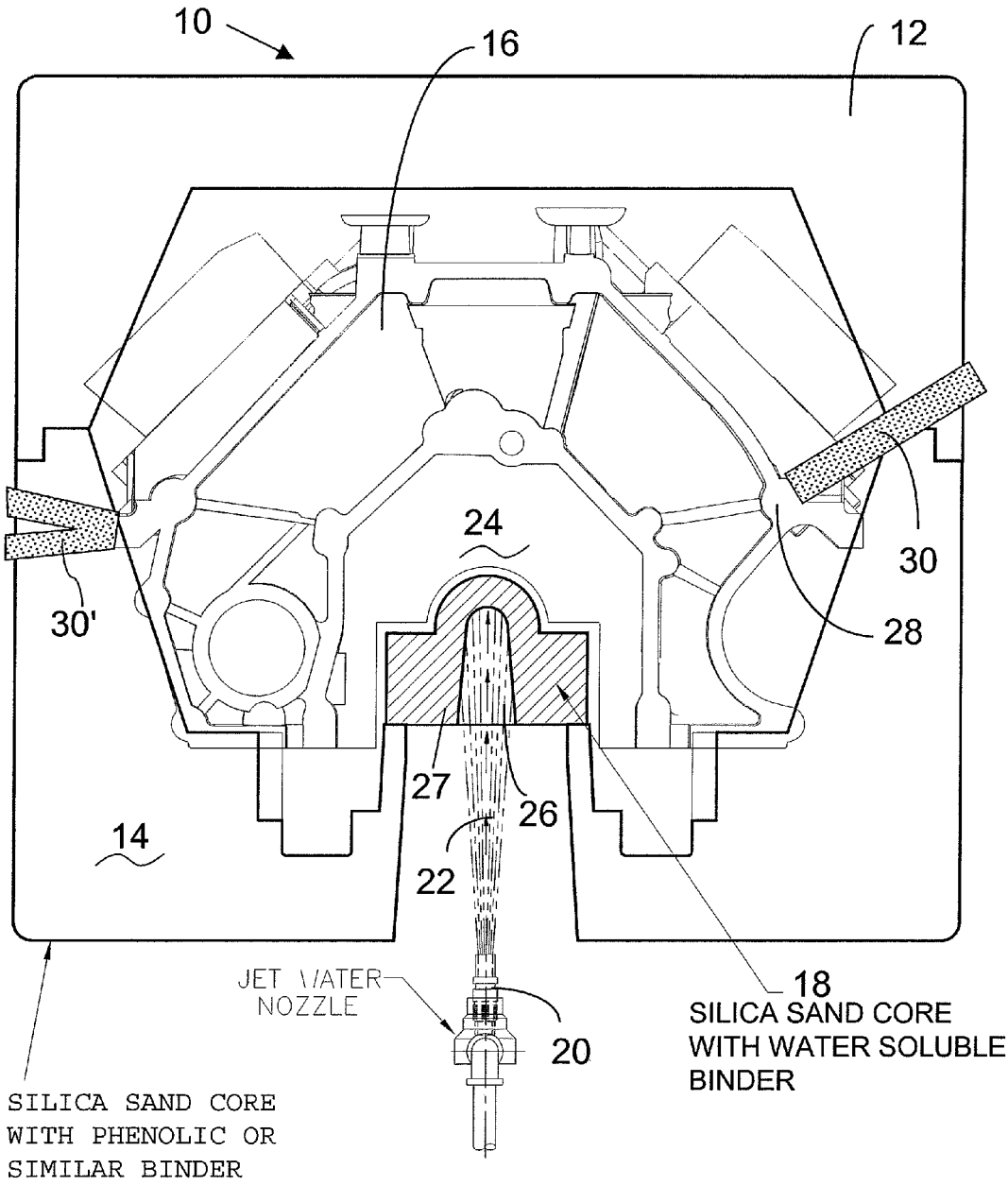
FIG. 1 is a schematic diagram of a front view of an aluminum alloy cylinder engine block with sand mold and cores illustrating a preferred embodiment of the present invention.
Figure 2:
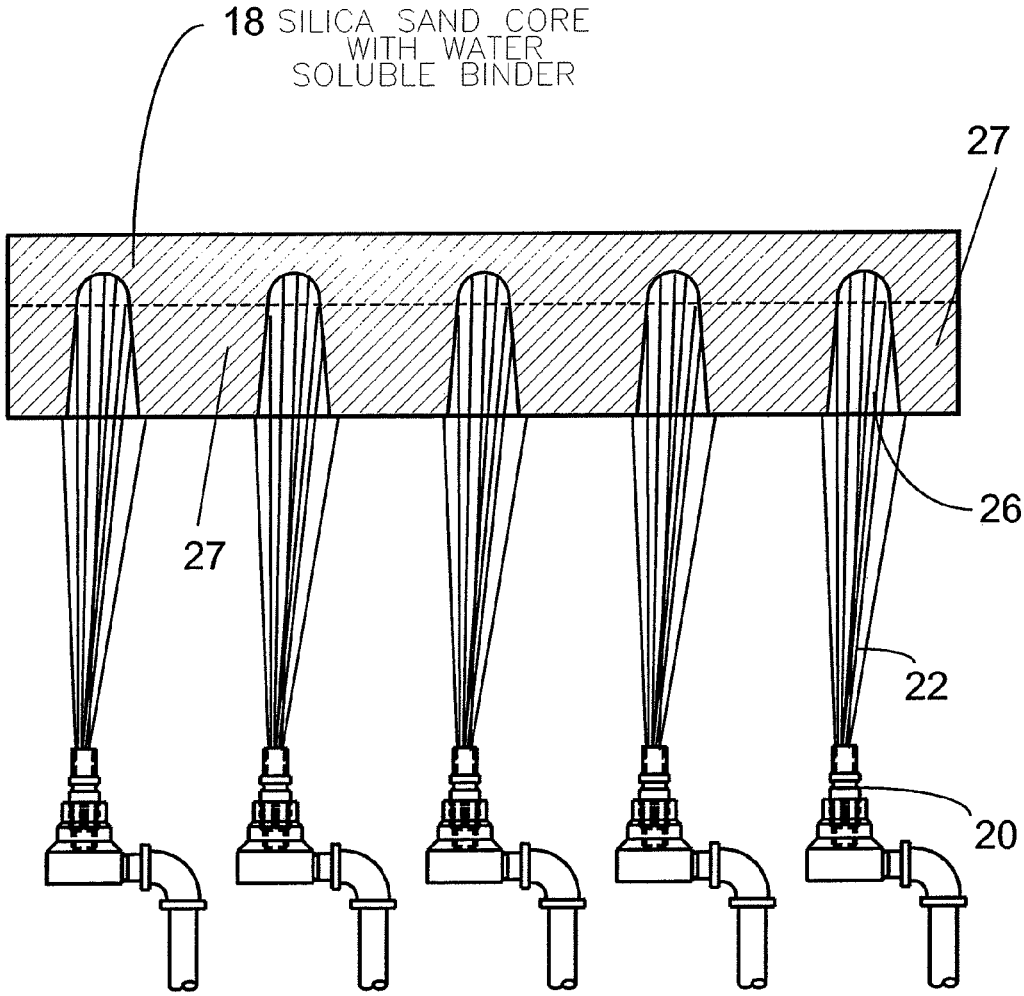
FIG. 2 is a schematic diagram of a side view of one of the water soluble core portions of FIG. 1, showing a plurality of cooling water jets each directed into a respective preformed hollow in said core portion ready to wash away said core portion (so as to quickly begin impinging directly on the block in the initial stage of solidification, but with a delay sufficient to assure needed support to the molten metal until the cooling has sufficiently solidified the surface of the casting to be self-supporting).

Referring to FIGS. 1 and 2, the numeral 10 designates generally a sand mold where the cylinder block is cast by filling the mold cavity with liquid aluminum alloy through a low pressure casting process.

Although the preferred embodiments of the invention are described below as applied to an aluminum alloy cylinder engine block casting and its mold used with a low pressure casting process; it will be understood that it may be also applicable to other types of castings and casting processes.

Similarly, in the preferred embodiments discussed below, the solvent is described as being water and the soluble binder is understood to be water-soluble; but other solvents and binders soluble therein may be used within the broader aspects of this invention.

The sand mold 10 has a cope portion 12 and a drag portion 14. In this embodiment, the cope and drag are made with an insoluble binder. A plurality of sand cores made with water soluble binder are set in a predetermined arrangement within said sand mold 12 and altogether define a casting cavity which is to be filled with liquid aluminum alloy to form the cylinder engine block 16.

A silica sand core 18 made with a water-soluble binder is placed in those areas of the aluminum block where a rapid cooling is desired. In the embodiment of the invention herein illustrated the portions of the block where a rapid cooling is desired at least include those portions close to the crankcase designated with numeral 24. This is not only to achieve directional cooling control from the crankcase area 24, but may also be to give enhanced hardening at that area 24 by a more rapid cooling and thereby to minimize precipitation of the hardening ingredient in the aluminum alloy.

A plurality of nozzles 20 direct water jets 22 against the core 18, which is bound with a water-soluble binder, and cause the destruction to remove said core 18. Suitable cavities 26 are optionally made in the core 18 to shorten the time needed for the water to dissolve the water-soluble binder of core 18. Thickness of the core 18 at the cavities 26, together with the at least temporary support structure 27 remaining between adjacent cavities, is sufficient to withstand the weight of the liquid aluminum filling the mold 10 and at the same time is as small as possible in order to facilitate the fast destruction of core 18 to enable the water to contact the aluminum alloy as soon as sufficient initial solidification has been achieved at the exposed area of impingement.

In another embodiment, the invention can be applied specifically to obtain better mechanical properties in some desired areas of the cast block, for example, in those areas where bolts will be placed for fastening other motor components to the block. One such area of the block is illustrated with numeral 28. A water-soluble core 30 is placed contacting such area 28 so that when a water jet is directed against said core 30, the binder is dissolved and the sand washed away and, therefore, the water rapidly contacts the block metal undergoing solidification. This quenching of the block at that point produces a particularly rapid cooling that improves the mechanical properties in the general area of impact relative to more remote areas in the mass of the casting, where cooling is less rapid but the mechanical properties are not as critical.

Binders with varying degrees of solubility can be used for even greater control. For example, core 18 can be formed with a binder that takes longer to dissolve than the binder used for core 30 (when subjected to the same conditions).

Though described as a core, the insert 30 can also be considered as being part of the cope portion 12 (likely differing only in its shape and its binder).

Having part of the mold be made with an insoluble binder allows other advantages; such as alternatively forming a core 30' in the shape of a "V" (with the apex engaging the casting). This permits the jet of cooling water to flow in one leg of the V and out the other leg. This is helpful in a narrow passage (and also aids in sweeping away any blanket of blocking steam that might tend to form, slowing the cooling process at the desired area 28). The generally V shape should be understood to be broadly inclusive of a U shape as well.

Jets of water can be directed at both legs of the V initially, and then one such jet can be shut down, once the two legs have been cleared of the sand in the V, to allow an unobstructed sweep of water through the V by the continued flow from the other jet.

The concept of the V can be more broadly applied; such as by having a first mold portion (formed with a soluble binder) in the shape of an internal core (such as similar to a water jacket cavity) with inlet and outlet legs accessing such core and set in a surrounding second mold portion (formed with an insoluble binder). The legs and core can have any shape, so long as it is feasible for the timely and effective removal of the sand and soluble binder by jets of solvent. The removal of the sand in said legs by jets of water result in flow passages through the second portions that help to focus and aid the flow of cooling water to the defined core area for accelerated cooling.

In a further embodiment of the invention in one of its broader aspects, the mold can be shaped to have only the portion(s) with insoluble binder forming the mold cavity, but having the portions thereof which are adjacent to the areas where rapid cooling is desired to be very thin and to be backed up by a supportive layer of mold portions formed with soluble binder. This would give a greater uniformity of surface in the resulting casting, while allowing cooling water to displace the sand with soluble binder early on and thus to rapidly play on the thin portions to initiate early directional cooling at the desired areas.

As used in this application, a "large complex casting" is used to mean a casting which is of sufficient size and/or complexity to make directional cooling a necessity to avoid voids or shrinkage porosity in the produced casting (so as to prevent a resultant,commercially-unacceptable, large number of defective castings).

What is claimed:

1. A method for forming an aluminum alloy casting in a sand mold, comprising:

providing a sand mold defining a cavity for forming said casting with at least one first portion of said mold formed with a binder soluble in a given solvent and at least one second portion formed with binder insoluble in said solvent, such at least one first portion being positioned to define respective areas of the casting cavity for achieving respective localized rapid cooling of the casting;

filling said mold with liquid aluminum alloy;

directing at least one cooling stream of solvent onto such at least one first portion to wash out such respective first portion to expose and directly cool the solidifying casting to give accelerated cooling of at least one respective defined area, with such at least one second insoluble portion serving to delimit such respective defined area and to protect the solidifying casting at the remaining locations of the casting cavity from such relatively accelerated cooling.

2. A method according to claim 1, wherein each cooling stream is initiated while the casting is still molten with the thickness of the respective first portion and the removal thereof by such cooling stream being adjusted to have the respective first portion remain intact sufficiently to support the molten casting during initial cooling at the respective defined area as needed, with removal to expose such area to direct impingement being accomplished once the casting in such defined area becomes self-supporting and maintaining said impingement on said casting for a time effective for improving the cooling rate and the mechanical properties of said casting at least in the region proximate to the respective defined area.

3. A method for forming a large complex aluminum alloy casting according to claim 2, wherein said respective defined area is positioned to achieve directional cooling remote from and directed towards a source of said liquid aluminum in a manner to avoid voids and shrinkage porosity.

4. A method according to claim 1 for low pressure casting of an aluminum alloy engine cylinder block in a sand mold having areas defining a crankcase housing and seats for bolts further comprising setting one of said first portions as a sand-core to define the crankcase housing and setting other first portions as cores to define seats for bolts.

* * * * *